United States Patent [19]

Josef et al.

[11] 4,186,780

[45] Feb. 5, 1980

[54] SEAM CONSTRUCTION FOR MULTI-LAYER FELTS

[75] Inventors: Michael J. Josef, Clifton Park; Eric R. Romanski, Delmar, both of N.Y.

[73] Assignee: Albany International Corp., Albany, N.Y.

[21] Appl. No.: 969,989

[22] Filed: Dec. 15, 1978

[51] Int. Cl.[2] ..... D03D 25/00; D03D 3/04

[52] U.S. Cl. ..... 139/383 A; 162/DIG. 1; 139/411; 139/425 A

[58] Field of Search ..... 139/383 A, 383 R, 408, 139/409, 410, 411, 412, 413, 425 A; 162/DIG. 1, 348, 349, 358; 245/10; 34/19; 24/33 R, 33 P, 33 V, 33 L, 33 C

[56] References Cited

U.S. PATENT DOCUMENTS

| | | | |
|---|---|---|---|
| 2,883,734 | 4/1959 | Draper | 139/383 A |
| 4,006,760 | 2/1977 | Romanski et al. | 139/383 A |
| 4,026,331 | 5/1977 | Lees et al. | 139/383 A |
| 4,141,388 | 2/1979 | Romanski et al. | 162/DIG. 1 |

FOREIGN PATENT DOCUMENTS

| | | | |
|---|---|---|---|
| 14167 | 9/1965 | Japan | 139/383 A |

*Primary Examiner*—Henry Jaudon
*Attorney, Agent, or Firm*—Kane, Dalsimer, Kane, Sullivan and Kurucz

[57] ABSTRACT

The disclosure is of a seam construction for joining the ends of woven papermakers felt or dryer felts, wet felts forming fabrics characterized in part by a first system of lengthwise yarns in one layer and a second system of lengthwise yarns positioned above the first system. The seam comprises looped ends of the lengthwise yarns projecting from the respective ends of the fabric, and positioned to interleaf with the opposite end loops. Pins are placed through the interleafed loops so as to provide joinder in the two systems, respectively, of the felt or fabric.

10 Claims, 5 Drawing Figures

10
12
14
16
18
20
22
24
26
28
30
32
4
4

SEAM CONSTRUCTION FOR MULTI-LAYER FELTS

BACKGROUND OF THE INVENTION

1. Field of the Invention

The invention relates to a seam construction for joining the ends of a belt, thereby making it endless, and more particularly relates to a pin seam construction for making endless a flat woven, multi-layered papermakers wet felt, dryer felt or forming fabric.

2. Brief Description of the Prior Art

The art is replete with descriptions of pin seam constructions for paper makers felts; see for example the disclosures of U.S. Pat. Nos. 3,436,041; 3,653,097; 4,026,331; and 4,006,760. In general, the seam constructions of the prior art have not been entirely satisfactory for all purposes and applications. This is particularly true of seam constructions for press fabrics or wet felts, dryer felts or forming fabrics of multi-layered construction fabricated from polymeric, non-metallic yarns.

The pin seam construction of our invention is advantageous for making endless, flat woven papermakers felts or multi-layered weave construction. The seams are exceptionally stronger than prior art seams for the same applications, do not adversely affect the desired flat surface of the endless felt, (that is, the seam is of a profile mating with the profile of the fabric) and facilitate change and installation of felts on the papermakers machine. The seam construction of the invention also exhibits longer life than prior art constructions and eliminates the need for cover pieces over the seam to prevent marking of the carried paper.

It will be appreciated that there are a wide variety of forms of endless woven belts employed in the papermaking industry and referred to as papermakers felts. The term "papermakers felts" includes the form commonly referred to as a "screen" fabricated by weaving synthetic monofilaments or twisted multi-filaments together in an open weave. Although not subjected to any form of milling, and therefore not "felts" in the original sense of the term, these screen fabrics have become known as "dryer felts", "press felts" and "forming fabrics".

SUMMARY OF THE INVENTION

The invention comprises a pin seam construction joining together the two ends of a multi-layers, woven papermakers felt or forming fabric, characterized in part by a first system of lengthwise yarns in one layer and a second system of lengthwise yarns positioned above the first system, which comprises; a plurality of first loops, protruding from the two ends of the fabric on a plane coextensive with the plane of the lengthwise yarns in the first system of lengthwise yarns; a plurality of second loops, protruding from the two ends of the fabric on a plane coextensive with the plane of the lengthwise yarns in the second system of lengthwise yarns; said loops being anchored in the body of the felt; said loops in one end being alternately displaced in respect to the loops of the other end so that the loops of the one end will interleaf with the loops of the other end when the ends are brought together to form a seam at the interleafed loops; a first pintle through the plurality of interleafed first loops; and a second pintle through the plurality of interleafed second loops; said pintles joining the interleafed loops in a seam construction.

The seam construction of the invention is advantageously employed to make endless, flat woven, multi-layers papermakers felt fabrics or forming fabrics. It is particularly advantageous for joining multi-layers screen fabrics such as is employed as a dryer felt in the dryer section of the papermaking machine or as the inner belt in the press section or press felt or forming fabrics particularly when the screen fabric is fabricated from synthetic, polymeric resin materials.

DETAILED DESCRIPTION OF THE PREFERRED EMBODIMENTS OF THE INVENTION

Those skilled in the art will readily appreciate the invention from the following discussion of the preferred embodiments when read in conjunction with the accompanying drawings of FIGS. 1–5 inclusive.

Figures 1, 2, 3:
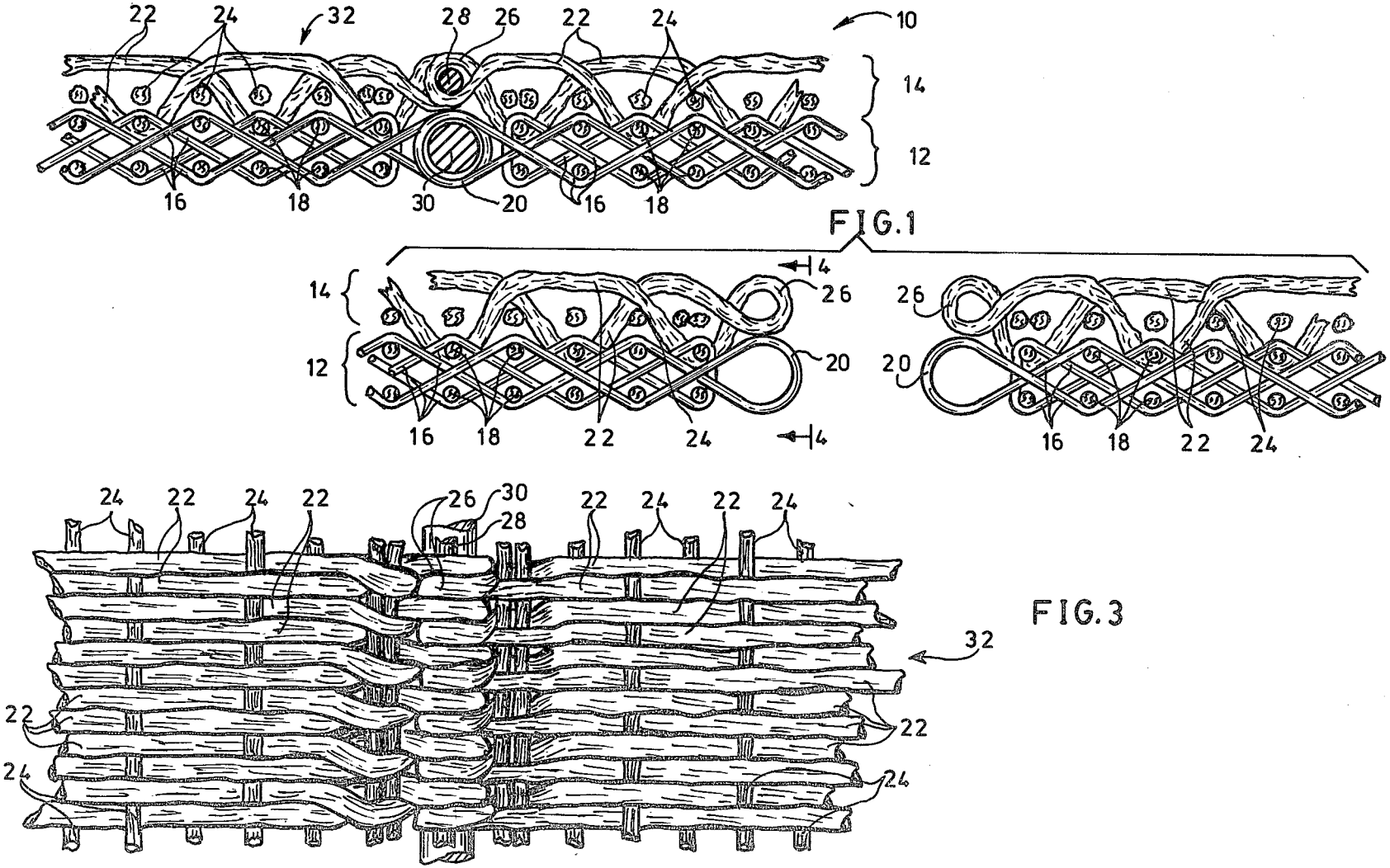
FIG. 1 is a cross-sectional, side elevation of the two ends of a flat papermakers felt, positioned adjacent to each other.
FIG. 2 is a fiew of the seam halves shown in FIG. 1 after they are joined in the seam construction of the invention.
FIG. 3 is a top view of the joined fabric shown in FIG. 2.

Referring first to FIG. 1, a cross-sectional side elevation is seen of the end portions of a length of flat woven dryer felt fabric 10, positioned end to end. The fabric 10 is a woven multi-layer fabric, free of binder yarns. As shown in FIG. 1, the base layer 12 of the fabric ends consists of a duplex type weave of lengthwise (warp) monofilament yarns 18. The base of interwoven monofilament yarns provides a high degree of stability and structural integrity to the fabric 10. Any commercially available monofilament, multifilament or spun yarns, preferably monofilament yarns having a diameter within the range of from about 0.002 to 0.040 inches may be advantageously employed as the yarns 16, 18. Representative of such yarns 16, 18 are multifilaments, monofilaments or spun yarns of polyamide, polyester, polypropylene, polyimide and like yarns. A number of lengthwise yarns 16 are provided having closed loops 20 at the fabric 10 ends. The loops 20 may be formed continuously from the lengthwise yarns 16 or they may be formed by conventional techniques well known to those skilled in the art. Alternatively, portions of the lengthwise yarns 16 may be removed and replaced by metallic or non-metallic eye pins to form a seam half at the ends of the fabric 10. As shown in FIG. 1, the upper surface or layer 14 of the fabric 10 consists of a single layer of interwoven spun yarns formed by the weaving of lengthwise or warp spun yarns 22 and cross-wise or filler spun yarns 24. The spun yarns 22, 24 may be any spun yarns conventionally employed in dryer felts and wet felts. Alternatively, the yarns 22, 24 may be monofilament or multifilament yarns. The yarns 22, 24 preferably have a size ranging from 100 grains to 3,000 grains per 100 yards. Generally, such yarns are represented by spun yarns of heat resistant, natural or synthetic staple fibers such as fibers of polyester, polyaramid, polybenzimazole, novoloid, polyamide, polyacrylic, wool and like fibers and blends thereof. Multi-filament yarns, when used in place of spun yarns may be fabricated from like materials and monofilaments may be as described above for yarns 16, 18. The soft, spun yarn surfaces provided by interwoven spun yarns 22, 24 are particularly advantageous in that they provide a heat and abrasion resistance barrier for the fabric 10 and tend to protect the base layer 12, which may otherwise be susceptible to degradation under heat and in the presence of moisture.

Figure 4:
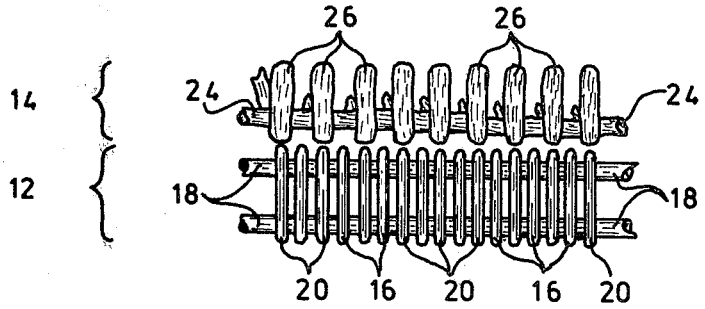
FIG. 4 is a view along lines 4—4 of FIG. 1.
Figure 5:
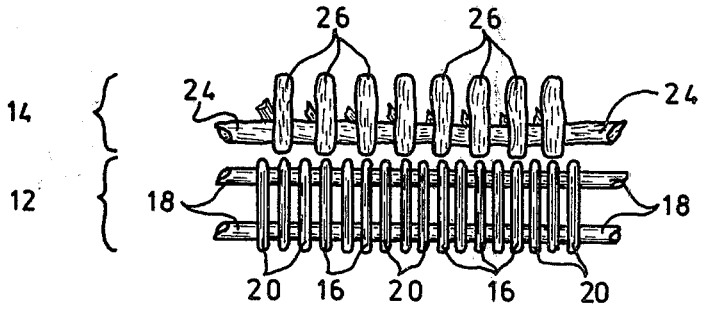
FIG. 5 is a view as in FIG. 4, but of an alternate embodiment construction of the invention.

The lengthwise yarns 22 in layer 14 also project from the ends of the fabric 10 to form closed loops 26. The closed loops 26 may be formed in the same manner described above for the formation of loops 20. The loops 20, 26 formed in the respective layers 12, 14 project outwardly from the ends of the fabric 10 as shown in FIG. 1 on a plane co-extensive with the plane of the lengthwise yarns in the system which they form. The loops are anchored in the body of the felt fabric 10 and are alternately displaced in respect to the loops of the opposite end so that the loops of one end will interleaf with the loops of the other end when the ends are brought together to form a seam at the interleafed loops. The loops 20 may be in vertical alignment with the loops 26 as best seen in FIG. 4, a view along lines 4—4 of FIG. 1 or they may also be alternately displaced in respect thereto as best seen in FIG. 5, a view as shown in FIG. 4, but of the alternate construction of displacement.

The lengthwise yarns 22 also function to integrate the layers 12, 14. As shown in FIG. 1, lengthwise yarns 22 in layer 14 occasionally dips to interweave with a cross-wise yarn 18 in the fabric base layer 12. The entire fabric structure 10 may be characterized as a smooth faced, multi-layer weave. The fabric 10 may be woven on a conventional papermakers felt loom in a single operation. In such an operation, the base yarns 16, 18 are woven while the yarns 22, 24 are woven directly above the base yarns 16, 18. The combining together of the two yarn systems in separate layers 12, 14 is performed during the weaving operation by sinking one of the yarns 22 to interlace with one of the base yarns 18. The combining of the two systems is preferably in a set sequence, for example, on every other cross-wise yarns 18 so as not to distort either the upper spun yarns surface 14 or the lower yarn base 12.

Referring now to FIG. 2, there is seen a cross-sectional, side elevation of the joined ends of fabric 10. In FIG. 2, those structures which are identical to those shown in the embodiments of FIG. 1 are numbered alike. To join the ends of the fabric 10 as shown in FIG. 2, the loops 20, 26 of one end are interleafed with the corresponding loops 20, 26 on the opposite end and a pintle or pin 30 is directed through the interleaved loops 20 and a pintle or pin 28 is directed through the interleaved loops 26 as shown in FIG. 2. Pin 28 may be fabricated from any conventional pin material. Thus, the ends of the fabric 10 are joined in a seam construction which consists of loops 20, 26 and pins 28, 30. In this manner, the fabric 10 is made endless for use on a papermaker machine.

Referring now to FIG. 3, a surface view of the embodiment of FIG. 2, one may see how the surface layer 14 loops 26 are interleafed to make a smooth, mark-free surface for the fabric 10. This construction is particularly advantageous in that it strengthens the entire seam construction between the end of the fabric 10, ensuring a stronger seam. Even if one of the seam components, i.e.; for example the joinder of the base layer 12 should fail, it is possible that the fabric 10 will still function on a papermaking machine, held together by the joinder of the upperlayer 14.

The following example describes the manner and process of making and using the invention and sets forth the best mode contemplated by the inventors of carrying out the invention but is not to be construed as limiting.

EXAMPLE 1

There is provided a quantity of 0.020 inch diameter polyester monofilament and a quantity of 0.021 inch diameter polyamide (nylon) monofilament yarn. There is also provided a quantity of 500 grain per 100 yard size spun acrylic/aramid (Nomex, DuPont Company) yarns having a ratio of 75% acrylic to 25% Nomex fibers. The monofilament yarns are woven together in a duplex pattern, i.e.; a double system of filling with a system of warp yarns to form a base. The base is composed of two "ends" of the polyester monofilament and two ends of nylon monofilament alternating across the width of the fabric. Each end (warp) runs the length of the fabric. The spun yarn is simultaneously woven on top of the monofilament so as to cover each pair of monofilaments, alternate spun yarns dropping down to interlace with alternate cross-wise monofilaments. The density of the monofilament warp yarns in the product is 48 ends to the inch in conjunction with 24 ends of spun yarn. The total end density is then 72 yarns to the inch. The number of fillings in the product is 25 monofilaments and 12½ spun yarns per inch for a total of 37½ fillings per inch. The ends of the product are freed to break the ends. Monofilament loops are woven back in the base layer and spun yarn loops are woven back in the upper soft layer to provide seam havles in each end of the fabric structure. The ends are then joined with a pin through the monofilament loops and a pin through the soft spun yarn loops to obtain an endless belt. When installed on a paper machine as a dryer felt the fabric performs well in the manufacture of papers. The belt tracks well, is easily guided and exhibits an exceptionally long life.

Those skilled in the art will appreciate that many modifications to the above described preferred embodiment may be made without departing from the spirit and the scope of the invention. For example, a forming fabric for use on the fourdrinier section of a paper making machine may be constructed wherein the upper layer 14 is also constructed of monofilament lengthwise and crosswise yarns in place of the spun or multifilament yarns. Such a screen fabric is ideally suited as a forming fabric on the fourdrinier section of a papermaking machine.

For another example, a wet felt for use in the press section of a papermaking machine may be constructed wherein the upper layer 14 is constructed of spun yarns in the lengthwise and crosswise directions and upon which is needled a web of carded nylon, polyester acrylic or like textile fibers. The needling operation will create a mechanical felted surface ideally suited for a wet felt for use in the press section of a papermaking machine.

Also, although the preferred embodiments described herein refer to duplex weave, the seam construction of the invention may be advantageously employed in papermakers' felts having more than two layers, with or without complete joinder of more than two of the layers in the manner described above.

What is claimed:

1. A pin seam construction joining together the two ends of a multi-layered, woven papermakers felt or forming fabric characterized in part by a first system of lengthwise yarns in one layer and a second system of lengthwise yarns positioned above the first system, which comprises;

a plurality of first loops protruding from the two ends of the fabric on a plane co-extensive with the plane of the lengthwise yarns in the first system of lengthwise yarns;

a plurality of second loops, protruding from the two ends of the fabric on a plane co-extensive with the plane of the lengthwise yarns in the second system of lengthwise yarns;

said loops being anchored in the body of the felt or fabric;

said loops in one end being alternately displaced in respect to the loops of the other end so that the loops of the one end will interleaf with the loops of the other end when the ends are brought together to form a seam at the interleafed loops;

a first pintle through the plurality of interleafed first loops; and a second pintle through the plurality of interleafed second loops;

said pintles joining the interleafed loops in a seam construction.

2. The pin seam construction of claim 1 wherein the lengthwise yarns in the first system are in vertical alignment with the lengthwise yarns in the second system.

3. The seam construction of claim 1 wherein the lengthwise yarns in the first system are displaced from a vertical alignment with the lengthwiseyarns in the second system.

4. The seam construction of claim 1 wherein the yarns in the first system are selected from the group consisting of spun yarns, multifilaments and monofilaments and the yarns in the second system are selected from the group consisting of spun yarns, multifilaments and monofilaments.

5. The seam construction of claim 4 wherein the yarns in the first system and the second system are monofilaments.

6. The seam construction of claim 4 wherein the yarns in the first system are monofilaments and the yarns in the second system are selected from the group consisting of spun yarns and multifilament yarns.

7. The seam construction of claim 1 wherein the two ends are of a forming fabric.

8. The seam construction of claim 1 wherein the two ends are of a papermakers felt.

9. The seam construction of claim 8 wherein the felt is a wet felt.

10. The seam construction of claim 8 wherein the felt is a dryer felt.

* * * * *